United States Patent [19]

Mathews

[11] Patent Number: 4,960,015

[45] Date of Patent: Oct. 2, 1990

[54] EXTENDABLE TORQUE BAR

[76] Inventor: Charlie V. Mathews, P.O. Box 293; Parker St., Reynolds, Ga. 31076

[21] Appl. No.: 517,742

[22] Filed: May 2, 1990

[51] Int. Cl.[5] ..... B25G 1/04

[52] U.S. Cl. ..... 81/177.2; 16/115

[58] Field of Search ..... 81/177.2; 16/115; 403/104–106, 330

[56] References Cited

U.S. PATENT DOCUMENTS

| | | | |
|---|---|---|---|
| 2,963,930 | 12/1960 | Clothier et al. | 81/177 |
| 4,317,393 | 3/1982 | Graffam | 81/177.2 |
| 4,703,677 | 11/1987 | Rossini | 81/471 |
| 4,754,670 | 7/1988 | Raymond | 81/177.2 |

*Primary Examiner*—D. S. Meislin

*Attorney, Agent, or Firm*—Michael V. Drew

[57] ABSTRACT

An extendable torque bar has a multi-sided rack member with teeth extending along a side, which fits within a tubular member whose bore has a geometric configuration corresponding to the rack member. The rack member has an adapter for engaging a socket for a nut or bolt, or the like. The tubular member has a second adapter at its rear end for engaging a tool or other driving mechanism. A pawl is supported by an annular member which is affixed to the tubular member. The annular member has an outer surface shaped like the frustum of a cone. The pawl fits through an opening in the annular member and is held in place and pivots about a pivot member projecting through the annular member. The teeth of the pawl contact the teeth of the rack member by extending through a slotted opening in the tubular member. When the pawl teeth are in contact with the rack teeth, the edge of the pawl opposite the side of the pawl containing the teeth coincides with the plane of the outer surface of the annular member. A sleeve fits over the pawl and annular member. The top inner surface of the sleeve corresponds to the outer surface of the annular member and envelops that outer surface. The sleeve is slidable along the tubular shaft and locks the bar when it is urged against the annular member by biasing means.

7 Claims, 3 Drawing Sheets

EXTENDABLE TORQUE BAR

TECHNICAL FIELD OF THE INVENTION

This invention relates generally to extendable torque bars.

BACKGROUND OF THE INVENTION

Torque bars are extensions which fit between a tool such as a torque wrench and a bolt, nut, or the like. There are several problems related to the use of telescopically extendable torque bars. One problem is that the bar often is not extendable in increments small enough to satisfy a diversity of needs. Another problem is that it is often difficult or time consuming to change the amount of extension from one length to another. A further problem is that the bar often can not accommodate a substantial applied torque.

U.S. Patents have issued for several extendable torque bars which exhibit one or more of the deficiencies described above. U.S. Pat. No. 2,963,930 to Clothier et al. discloses an extensible torque bar which is extendable in increments defined by a ball bearing and accommodating elliptical depressions in the torque rod. The increments in which this bar may be extended are limited because of the distance that the elliptical depressions must be spaced apart in order for the apparatus to operate. The strength of the bar is limited because the torque which would be applied from a tool such as a wrench to the torque tube is applied to the torque rod only through a square engagement member of limited size. This square engagement member engages the torque tube only along a very small portion of its length.

U.S. Pat. No. 4,703,677 to Rossini discloses a torque bar which is not easily extendable over large increments. The extending shaft is extended by turning an adjustment nut or screw. This adjustment nut or screw must be turned many times to accomplish anything other than a very small change in length.

U.S. Pat. No. 4,754,670 issued to Raymond discloses a torque bar which is not easily extended. In order to extend the bar, it must be detached from the tool with which it is being used and a screw driver, allen wrench, or similar device must be inserted into an end of the torque sleeve to turn a screw that is embedded in the end of the elongated torque member.

SUMMARY OF THE INVENTION

It is an object of this invention to provide an extendable torque bar whose length may be quickly and easily altered in very small increments or very large increments.

It is another object of the invention to provide an extendable torque bar which is able to receive a significant applied torque force.

According to a broad aspect of the invention, a multi-sided rack member which has teeth extending along a side fits within a tubular member whose bore has a geometric configuration corresponding to that of the rack member. The rack member has a first adapter at its front end for engaging a socket for a nut or bolt or the like, or for otherwise engaging a workpiece. The tubular member has a second adapter at its rear end for engaging a tool or other driving mechanism. The extension of the rack member from the tubular member is controlled by a pawl working in conjunction with the teeth of the rack member. The pawl is supported by an annular member which is affixed to the tubular member.

The annular member has an outer surface shaped like the frustum of a cone. The pawl fits through an opening in the annular member and is held in place and pivots about a pivot member projecting through the annular member. The teeth of the pawl contact the teeth of the rack member by extending through a slotted opening in the tubular member. When the pawl teeth are in contact with the rack teeth, the edge of the pawl opposite the side of the pawl containing the teeth coincides with the plane of the outer surface of the annular member. A sleeve fits over the pawl and annular member. The top inner surface of the sleeve corresponds to the outer surface of the annular member and envelops that outer surface. The sleeve is slidable along the tubular shaft and is urged against the annular member by a biasing means.

The invention is extendable in increments defined by the distance between the teeth of the rack member. The teeth of the pawl fit between the teeth of the rack member and thereby prevent to and fro movement of the rack member except upon movement or disengagement of the teeth of the pawl. The pawl is held in place when the bias means urges the sleeve against the annular member which supports the pawl. The top inner surface of the sleeve forces the outer edge of the pawl to become aligned with the outer surface of the annular member. This causes the teeth of the pawl to engage the teeth of the rack member. The pawl may be disengaged by urging the sleeve against the bias means and away from the annular member.

The invention is able to withstand a substantial applied torque because the multi-sided rack member contacts the multi-sided bore of the torque tube along the length of the rack member which is enclosed by the bore of the torque tube. The invention is further strengthened by a reinforced segment of the torque tube near its closed end. Reinforcement may be simply accomplished by lengthening the solid portion of the torque tube that lies between the end of the bore of the tube and the second adapter member.

The invention may also contain a stopping mechanism which prevents the rack member from being completely withdrawn from the torque tube or from being withdrawn from the torque tube beyond a point of optimal use.

The invention allows the torque bar to be quickly and easily telescopically extended or retracted in very large or very small increments. In addition, the torque bar is able to withstand a substantial applied torque without shearing or deforming of the rack member or torque tube.

Other aspects, objects, features, and advantages of the present invention will become apparent to those skilled in the art upon reading the detailed description of preferred embodiments in conjunction with the accompanying drawings and appended claims.

DETAILED DESCRIPTION OF PREFERRED EMBODIMENTS OF THE INVENTION

While the specification concludes with claims particularly pointing out and distinctly claiming the subject matter which is regarded as the present invention, the invention will now be described by reference to the following description of preferred embodiments taken in conjunction with the accompanying drawings.

Figure 1:
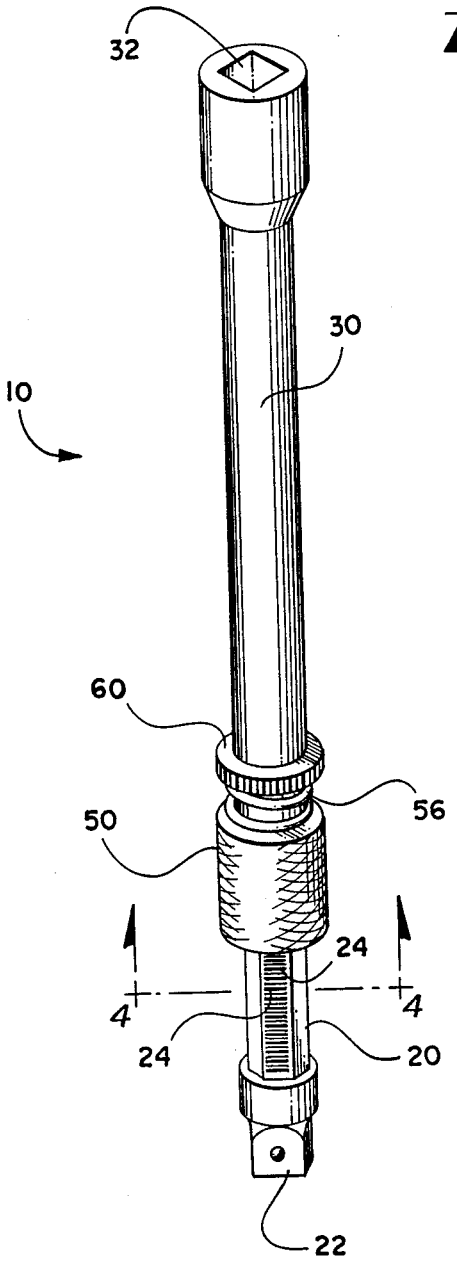
FIG. 1 is an isometric view of an extendable torque bar embodying the teachings of the present invention.
Figure 3:
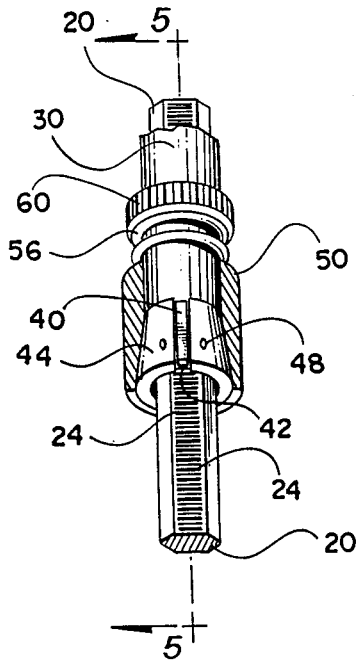
FIG. 3 is a partial view of the invention of FIG. 1 with a portion of the sleeve cut away.
Figure 4:
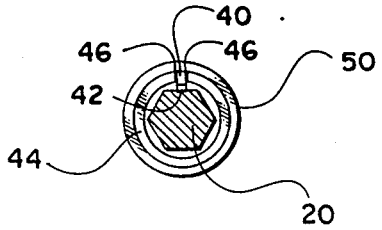
FIG. 4 is a sectional view of the invention of FIG. 1 taken along line IV—IV of FIG. 1.
Figure 2:
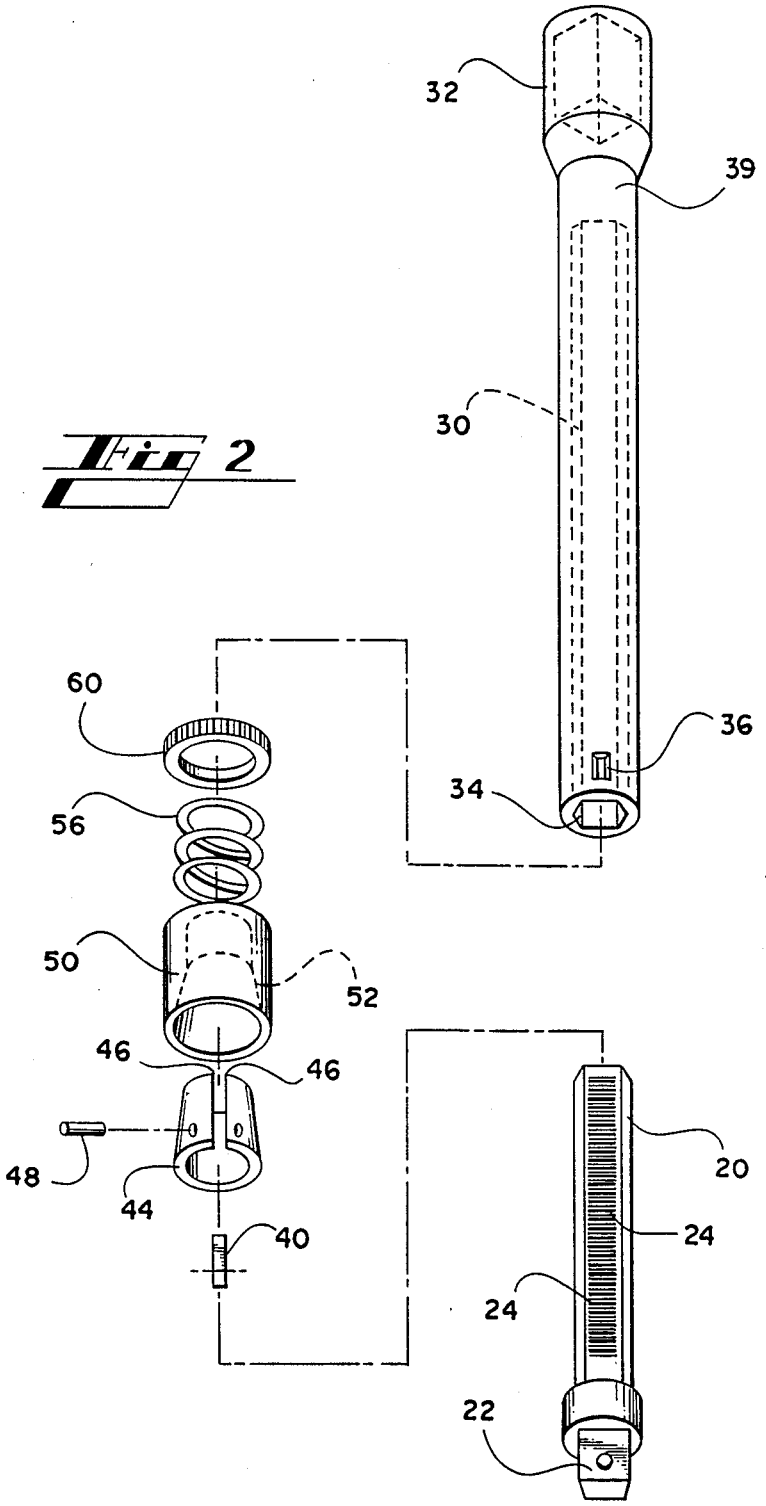
FIG. 2 is an exploded view of the invention of FIG. 1.

In the drawings, which are discussed below, the same reference numerals refer to the same features of the invention throughout the drawings. An extendable torque bar according to a preferred embodiment of the invention is shown in FIG. 1. The primary parts of the torque bar 10 are a rack member 20 which extends from a torque tube 30. Rack member 20 has a first adapter member 22 affixed to the exposed end of the rack member 20. In this embodiment, the adapter is a male-type adapter suitable for engaging a socket or similar tool piece or work piece. The rack member 20 has multiple sides. The embodiment shown is a solid hexagonal member. Teeth 24 are defined along one of the sides. The rack member 20 is encased in a torque tube 30. A second adapter 32 is affixed to the end of the torque tube 30 which is opposite the end of the torque tube 30 through which the rack member 20 is inserted. In this embodiment, the second adapter 32 is a female-type adapter for receiving a torque wrench or the like. Referring now also to FIG. 2, therein is shown all of the elements of the torque bar 10 in an exploded view. The torque tube 30 has a multi-sided bore 34 which corresponds to the multi-sided rack member 20. In this embodiment, the hexagonal bore 34 mirrors and closely receives the hexagonal rack member 20. Other combinations of geometric shapes for the rack and bore are possible. For example, a square rack and square bore, or an octagonal rack and octagonal bore, or even a hexagonal rack and square bore. A pawl support ring 44 is an annular member which serves as part of the locking mechanism for the torque bar 10. The pawl support ring 44 can be seen adjacent the torque tube 30 at the end which receives the rack member 20. Enveloping the pawl support ring 44 is a sleeve 50. In FIG. 1, the sleeve 50 is shown in its normal resting position where it is biased into that position by a helical spring 56. The helical spring 56 is secured by a spring retaining ring 60 which is secured around the torque tube 30.

Referring generally to FIGS. 2 through 5, in addition to the features which have already been discussed, the components of the locking mechanism are also shown. The principal component of the locking mechanism is a pawl 40 which has teeth 42 for engaging the teeth 24 of the rack member 20. The pawl teeth 42 extend through a slotted opening 36 in the torque tube 30. The pawl 40 is supported by the pawl support ring 44 and pawl pivot member 48. The pivot member 48 in this embodiment is a pin. The pawl 40 fits into the opening 46 of the pawl support ring 44 and is pivotable about the pawl pivot member 48. The pawl 40 has portions adjacent either side of the pawl teeth 42 that do not contain teeth. This allows the pawl 40 to be disengaged from the rack member 20 by pivoting the pawl 40 until the pawl teeth 42 do not contact the rack teeth 24 of the rack member 20. A single pawl tooth 42 would be sufficient to engage the rack teeth 24, however, multiple teeth may be used to insure stability. The pawl support ring 44 has an inner surface which conforms to and immovably contacts the torque tube 30. The pawl support ring 44 has an outer surface 45 which resembles the frustum of a cone. The outer surface 45 diverges toward the open end of the torque tube 30. The pawl 40 has a sloped edge 43 opposite the side of the pawl 40 containing the pawl teeth 42. When the pawl teeth 42 engage the rack teeth 24 of the rack member 20, the sloped edge 43 coincides with the plane of the outer surface 45 of the pawl support ring 44. The sleeve 50 has an inner surface at its top end which corresponds to the frusto-conical shape of the outer surface 45 of the pawl support ring 44. When the inner conical wall 52 of the sleeve 50 is in close contact with and seated over the outer surface 45 of the pawl support ring 44, the sloped edge 43 of the pawl is forced into alignment with the plane of the outer surface 45 of the pawl support ring 44. This positioning locks the pawl 40 into a position wherein the pawl teeth 42 engage the rack teeth 24 of the rack member 20. The bottom of the sleeve 50 has an inner surface which corresponds to the shape of the outer surface of the torque tube 30. The sleeve 50 is slidable along the torque tube 30. The sleeve 50 is biased into a position wherein the inner conical wall 52 of the sleeve 50 fully contacts the outer surface 45 of the pawl support ring 44. The bias means in this embodiment is the helical spring 56.

In its resting position, the extendable torque bar 10 is biased in a locked position. The rack member may be easily and quickly extended from or retracted into the torque tube 30 by grasping the sleeve 50 and urging it against the spring 56. As the inner conical wall 52 of the sleeve 50 disengages the outer surface 45 of the pawl support ring 44, the pawl 40 is allowed to freely pivot about the pawl pivot member 48. As the sleeve 50 is held against and compresses the spring 56, the rack member 20 may be extended or retracted to any desired interval. The pawl teeth 42 do not present any resistance to the rack teeth 24 of the rack member 20 because the pawl 40 is freely pivotable to its toothless portions. The minute distance between a pair of rack teeth 24 defines the smallest increment of change of length for the bar 10. Thus, the bar 10 may be manipulated as just described to change its length by only one rack-tooth interval or by as many rack-teeth intervals as desired.

Figure 6:
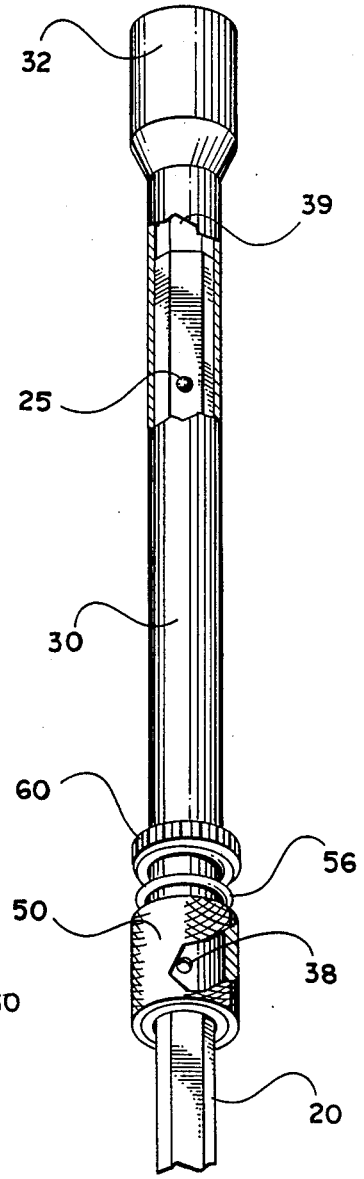
FIG. 6 is an isometric view of an extendable torque bar embodying further teachings of the present invention.

The torque bar 10 is able to withstand a substantial applied torque without bending or deformation of the rack member 20 or torque tube 30 because the torque force is distributed evenly about the multiple sides of the rack member 20 and torque tube bore 34. Referring now particularly to FIGS. 2 and 6, there can be seen a reinforced portion 39 of the torque tube 30 which imparts additional strength to the torque tube 30. As shown in this embodiment, the reinforced portion 39 is a solid portion of the torque tube 30 extending between the torque tube bore 34 and the second adapter member 32.

Figure 7:
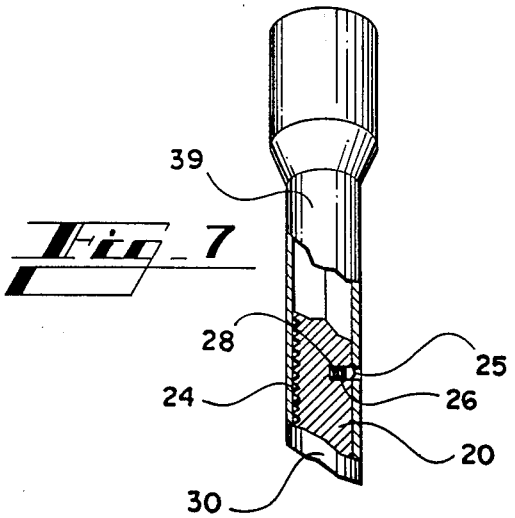
FIG. 7 is a partial sectional view of the invention of FIG. 6.
Figure 5:
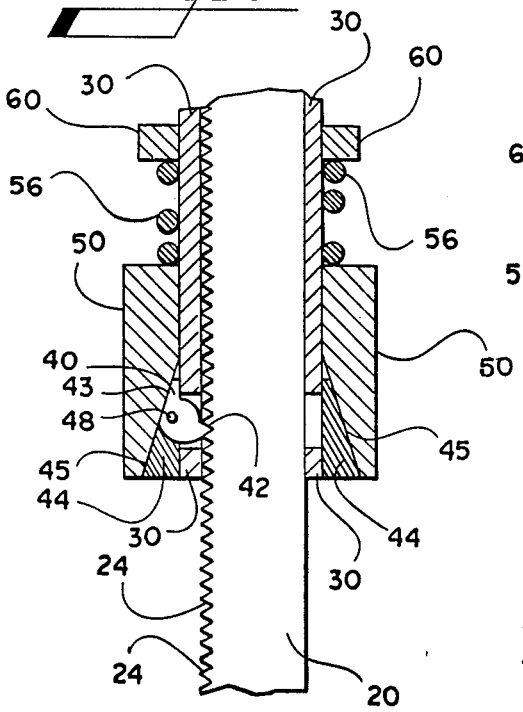
FIG. 5 is a sectional view of the invention of FIG. 1 taken along line V—V of FIG. 3.

Referring now to FIGS. 6 and 7, there is illustrated in conjunction with the torque bar 10 which has been previously described, a mechanism for preventing the rack member 20 from being completely withdrawn from the torque tube 30 or from being withdrawn past a point which is desirable for maximum application of a torque force. Stopping is accomplished when a spring loaded ball bearing 25 which resides in a cavity 26 in one of the sides of the rack member 20 comes into contact with the aperture 38 in the torque tube.

Referring now also to FIG. 7, a sectional view of the rack member 20 illustrates how the ball bearing 25 rests upon a spring 28 within a cavity 26 through a side of the rack member 20. The ball bearing spring 28 exerts a force against the ball bearing 25. As the rack member 20 traverses the torque tube bore 34, the ball bearing 25 rolls freely along the inner surface of the torque tube 30 which defines the bore 34. Further motion of the rack member 20 is prevented when the rack member 20 is extended to the point where the ball bearing 25 seats itself in the aperture 38 of the torque tube 30. When desired, the rack member 20 may be moved from this locked position by the exertion of sufficient axial force upon the rack member 20 to overcome the force of the ball bearing spring 28 which urges the ball bearing 25 into the aperture 38.

As should be apparent from the foregoing specifications, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. An extendable torque bar comprising:

a multi-sided rack member having teeth extending along a side, and having a rear end and a front end, and having a first adapter member fixedly attached adjacent said front end;

a tubular member defining a multi-sided bore corresponding to said multi-sided rack member, for receiving said multi-sided rack member, said multi-sided bore and said tubular member defining an opening at a front end of said tubular member and defining a slot through a side of said multi-sided bore proximate said front end, and having a rear end and a second adapter member fixedly attached adjacent said rear end, said multi-sided rack member slidably inserted in said tubular member through said opening of said tubular member with said side of said multi-sided rack member having teeth facing said side of said multi-sided bore which defines said slot;

an annular member defining an opening in a circumference of said annular member, said annular member securely attached around said tubular member with said opening in a circumference of said annular member positioned over said slot, said annular member having a frusto-conically-shaped outer surface diverging toward said front end of said tubular member;

a pawl having at least one tooth, a sloped edge distal said at least one tooth, and a portion between said at least one tooth and said slopped edge that does not contain teeth, said pawl movably inserted through said opening of said annular member, with said at least one tooth of said pawl projecting through said slot in said tubular member and said sloped edged coincident with a plane defined by said frusto-conically-shaped outer surface of said annular member when said at least one tooth of said pawl fully engages said teeth of said multi-sided rack member;

a pivot member projecting through said annular member across said opening in said annular member and through said pawl so that said pawl is pivotable about said pivot member;

a sleeve slidably fitting over said annular member and around said tubular member proximate said annular member, said sleeve member having an outer surface, a top end and bottom end, and defining an inner surface at said top end having an inverted frusto-conical shape corresponding to said frusto-conically-shaped outer surface of said annular member, said sleeve member defining a cylindrical inner surface at said bottom end corresponding to said tubular member, said sleeve member slidably engaging said tubular member adjacent said annular member with said top end adjacent said annular member; and bias means urging said sleeve member against said annular member.

2. The invention of claim 1, wherein said multi-side rack member and said multi-sided bore are hexagonal.

3. The invention of claim 1, said bias means comprising:

a helical spring around said tubular member below said sleeve member, said helical spring having a top end and a bottom end, said top end of said helical spring adjacent said bottom end of said sleeve member; and a ring member fixedly attached around said tubular member below said helical spring and adjacent said bottom end of said helical spring for securing said helical spring in position.

4. The invention of claim 1, further comprising means for reinforcing said tubular member against shearing.

5. The invention of claim 4, said means for reinforcing said tubular member against shearing comprising a solid member interposed between said rear end of said tubular member and said second adapter member.

6. The invention of claim 1, further comprising means for preventing said multi-sided rack member from being withdrawn from said tubular member beyond a designated point.

7. The invention of claim 6, said means for preventing said multi-sided rack member from being withdrawn from said tubular member comprising:

said multi-sided rack member defining a cavity for receiving a ball bearing in a side of said multi-sided rack member, said cavity having a bottom end;

a ball bearing within said cavity;

a helical spring member within said cavity between said ball bearing and said bottom end of said cavity urging said ball bearing out of said cavity; and said tubular member defining at said top end thereof, proximate said opening thereof, an aperture for receiving and seating said ball bearing.

* * * * *